United States Patent [19]

Greene et al.

[11] 3,954,261

[45] May 4, 1976

[54] INKED PAPER TRANSPORT MECHANISM EMPLOYING A PAIR OF BEVELED ROLLERS

[75] Inventors: Robert I. Greene, Rochester; Thomas M. Madigan, Pittsford, both of N.Y.

[73] Assignee: Itek Corporation, Lexington, Mass.

[22] Filed: Jan. 3, 1975

[21] Appl. No.: 538,485

[52] U.S. Cl. ..... 271/188; 271/174; 271/272; 101/232

[51] Int. Cl.[2] ..... B65H 29/70

[58] Field of Search ..... 271/DIG. 2, 80, 174, 271/188, 209, 272, 273, 274; 101/232, 420; 118/245

[56] References Cited

UNITED STATES PATENTS

| | | | |
|---|---|---|---|
| 197,477 | 11/1877 | Kneeland | 271/188 |
| 281,150 | 7/1883 | Smith et al. | 271/209 |
| 1,934,224 | 11/1933 | Broadmeyer | 271/188 |
| 2,796,259 | 6/1957 | Fawcett | 271/188 |
| 3,558,109 | 1/1971 | Sofue | 271/272 |

*Primary Examiner*—Evon C. Blunk
*Assistant Examiner*—Robert Saifer
*Attorney, Agent, or Firm*—Homer O. Blair; Robert L. Nathans; Gerald H. Glanzman

[57] ABSTRACT

A transport mechanism is disclosed for driving inked paper emerging from the printing station of a duplicating machine into a stacking station, the transport mechanism employing a first pair of beveled drive rollers and a second pair of rounded rollers biased against the beveled drive rollers by gravity which prevents ink buildup upon the second pair of drive rollers where bleed edge inked paper is being transported through the system.

11 Claims, 2 Drawing Figures

FIG. 1.
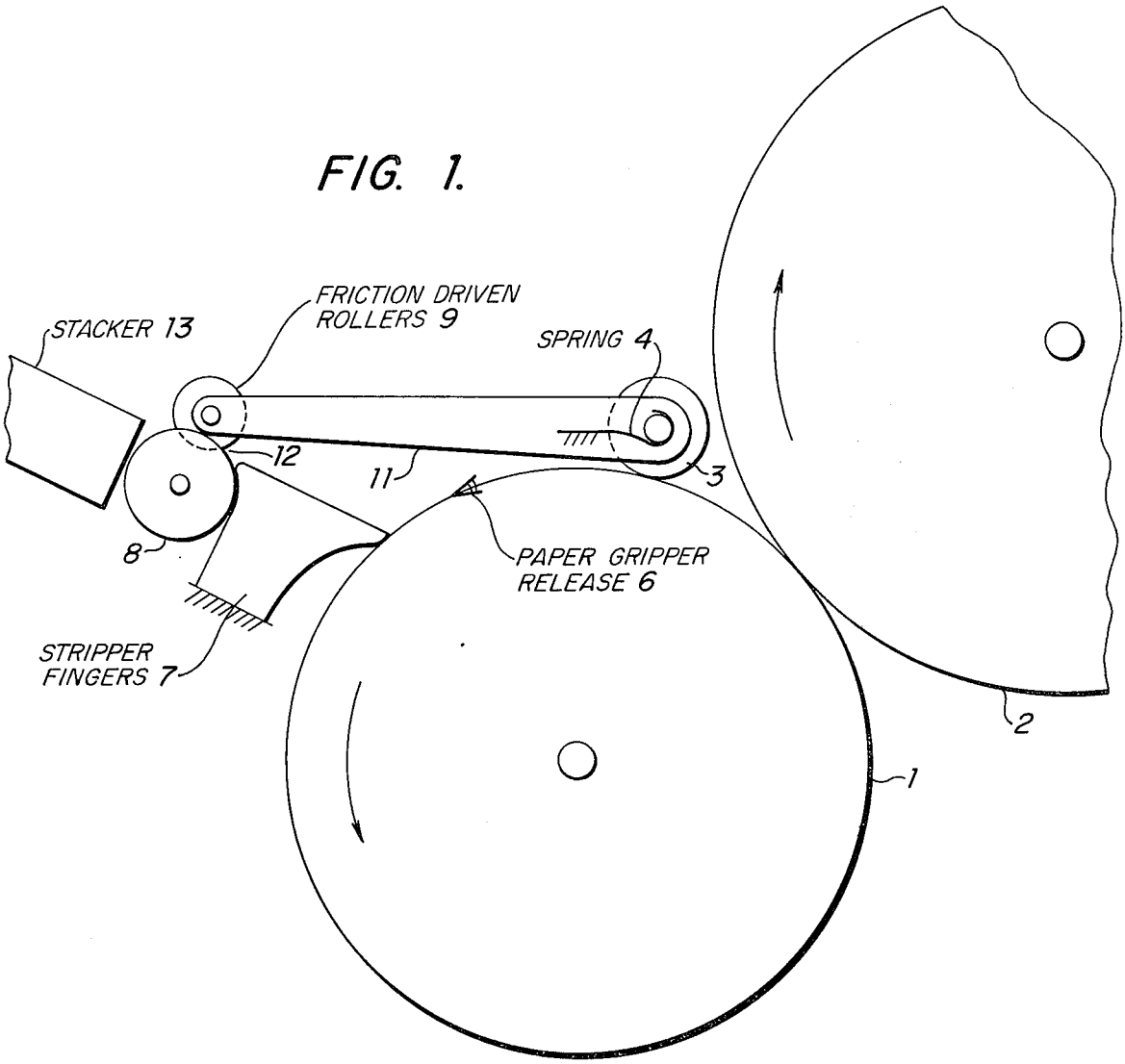
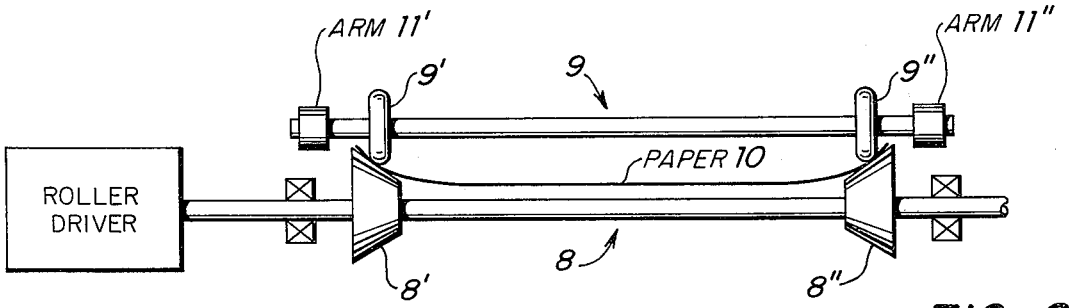
FIG. 2.

INKED PAPER TRANSPORT MECHANISM EMPLOYING A PAIR OF BEVELED ROLLERS

BACKGROUND OF THE INVENTION

It has been found that where inked paper is transported from the printing station of a copier-duplicator to a stacking station, that conventional transport rollers often have ink built up on the periphery of such rollers in cases where the rollers contact inked portions of the paper emerging from the printing station. Since the drive rollers contact the paper along outer borders thereof, this situation occurs most commonly where the paper carries bleed edge printing, that is, inked indicia which extends fairly close to the edges of the paper. The buildup of ink on the transport rollers can produce a black line along margin portions of the paper after a time which is aesthetically undesirable. One prior art solution involves contacting the periphery of the drive rollers with a wick saturated with water. However, this prior art approach can be somewhat messy, at least for certain desired configurations and the wicks are susceptible to being dried out which renders them ineffective to prevent further ink buildup. It is thus highly desirable to employ a first and second pair of drive rollers which do not require the use of a wick and which are designed in a simple and economic manner to thwart this buildup of ink.

SUMMARY OF THE INVENTION

In accordance with a preferred embodiment of the invention, a first pair of beveled drive rollers and a second pair of coacting drive rollers having rounded peripheries have been found, for reasons that are not well understood, to eliminate the above-mentioned ink buildup problem. Preferably, the second pair of drive rollers having rounded peripheries are biased by gravity against beveled portions of the first pair of drive rollers.

Other objects, features and advantages of the present invention will become apparent upon the perusal of the following description taken in conjunction with the drawings in which:

FIG. 1 illustrates a transport system employing the roller drive mechanism of the present invention; and FIG. 2 further illustrates the first and second pair of drive rollers.

SPECIFIC DESCRIPTION

In FIG. 1, an impression cylinder 1 is illustrated contacting a plate cylinder 2 which bears a printing plate, not shown, for printing upon sheets of paper transported between the contact area of cylinders 1 and 2 in the conventional manner. A drive roller 3 is biased against impression cylinder 1 by means of spring 4. A conventional paper gripper 6 is actuated at the position shown to release the leading edge of the paper to enable the sheet to be driven over stripper finger 7 and into the nip of roller drive means 8 and 9, all in the conventional manner. Roller drive means 8 and drive roller means 3 are positively driven by motor means not shown. First roller drive means 8 is further illustrated in FIG. 2 and includes beveled rollers 8' and 8'' mounted upon a common drive shaft, whereas roller drive means 9 includes rollers 9' and 9'' having rounded peripheries as illustrated. The common drive shaft supporting rollers 9' and 9'' is rotatably mounted upon guide arms 11' and 11'' which in turn are rotatably supported at drive roller 3 as indicated in FIG. 1. As a result of this arrangement, the second roller drive means 9 rides upon the first roller drive means 8 as shown in FIG. 2, and is biased by the force of gravity acting on the second roller drive means and guide arm means 11.

In FIG. 2, paper 10 is shown driven through the nips of the first and second roller drive means, said paper having bleed edge printing on the upper surface thereof. It has been found, surprisingly, that the coaction between the rounded peripheries of rollers 9' and 9'' and the beveled portions of rollers 8' and 8'' eliminates the buildup of ink upon rollers 9' and 9''. Preferably, the peripheral portions of the second drive roller means 9 have a circular cross section, but it is believed that any rounded arcuate portions will be satisfactory. It is believed that the roller bevel angle with respect to the longitudinal roller axis is not particularly critical, although an angle of about 30° is preferable. Angles between 25° and 35° have also been found satisfactory. The described embodiment of the invention will work by itself for thin ink films. However, if the ink film is thick, roller set 3 must be kept wet by a conventional wicking system.

In the transport mechanism constructed by the inventors, it has been found to be satisfactory to employ the following parameters:

1. Diameter of largest portion of rollers 8' and 8'': 1¾ ± ⅛ inch. Diameter of smallest portion of rollers 8' and 8'': 1⅛ ± ⅛ inch.
2. Angle of beveled roller portion with respect to the longitudinal axis of shaft 8: 25°–35°.
3. RPM of rollers 8' and 8'': 560 ± 30 RPM.
4. Diameter of rollers 9' and 9'': 1⅛ ± ⅛ inch.
5. Material of rollers 8' and 8'': metal or plastic or rubber covered metal.
6. Material of rollers 9' and 9'': stainless steel or chrome plated steel.
7. Contact forces between rollers 8' and 9' and 8'' and 9'': 3 ounces.

It is believed that the magnitudes of these roller contact forces are not particularly critical, except that if the forces are too small, ink buildup will occur. Additionally, it is believed that the invention will be effective to prevent roller ink buildup of most oil based inks. About three types of inks were employed and satisfactory results were obtained. Some of the inks may be identified as follows: "Polychrome" Itek Automatic Duplicating System Ink, "Syn-Dry IV" Ink, "Braden-Sutfin" Ink.

While preferred embodiments of the invention have been described, the teachings of this invention will readily suggest many other embodiments to those skilled in the art.

What is claimed is:

1. An inked paper transport mechanism comprising:

a. a first pair of beveled drive rollers; and, b. a second pair of drive rollers for driving inked sheets between said first pair of drive rollers and said second pair of drive rollers, said second pair of drive rollers having rounded peripheries biased against the beveled portions of said first pair of drive rollers, said inked sheets having inked portions contacting said rounded peripheries of said second pair of drive rollers.

2. The device as set forth in claim 1 wherein said beveled portions of said first pair of drive rollers are oriented at an angle of between 25°–35° with respect to the longitudinal axis of the support shaft for said first pair of beveled drive rollers.

3. The device as set forth in claim 2 wherein said beveled portions make an angle of about 30° with respect to the longitudinal axis of the support shaft for said first pair of beveled drive rollers.

4. The device as set forth in claim 1 further including a guide arm for rotatably supporting said second pair of drive rollers, together with means for pivotably supporting said guide arm so that said second pair of drive rollers are biased against said first pair of drive rollers by gravity.

5. The device as set forth in claim 2 further including a guide arm for rotatably supporting said second pair of drive rollers together with means for pivotably supporting said guide arm so that said second pair of drive rollers are biased against said first pair of drive rollers by gravity.

6. The device as set forth in claim 5 wherein one portion of said guide arm is coupled to said second pair of drive rollers and a second portion of said guide arm is rotatably coupled to a third pair of drive rollers for driving paper emerging from a printing station toward said first and second pair of drive rollers.

7. The device as set forth in claim 6 further including a paper guide means positioned intermediate said first and second pair of drive rollers on the one hand and said third pair of drive rollers on the other hand.

8. An inked paper transport mechanism comprising:

a. a first pair of beveled drive rollers mounted on a beveled roller drive shaft, said drive rollers being beveled at an angle of between 25° and 35° with respect to the longitudinal axis of said beveled roller drive shaft;

b. a second pair of drive rollers for driving inked sheets between said first pair of drive rollers and said second pair of drive rollers, said second pair of drive rollers having rounded peripheries biased against the beveled portions of said first pair of drive rollers, said inked sheets having inked portions contacting said rounded peripheries of said second pair of drive rollers; and, c. means for mechanically biasing said first pair of drive rollers and said second pair of drive rollers together at a contact force of about three ounces at each contact portion.

9. The mechanism as set forth in claim 8 wherein said angle is 30°.

10. An inked paper transport mechanism comprising:

a. a first pair of beveled drive rollers mounted upon a drive shaft and wherein the bevel angle with respect to the longitudinal axis of said drive shaft is 30°, the diameter of the largest portion of each beveled drive roller is about 1¾ inches and the diameter of the smallest portion of each beveled drive roller is about 1⅛ inches;

b. a second pair of drive rollers for driving inked sheets between said first pair of drive rollers and said second pair of drive rollers, said second pair of drive rollers having rounded peripheries biased against the beveled portions of said first pair of drive rollers and wherein the diameter of said second pair of drive rollers is about 1⅛ inches, said inked sheets having inked portions contacting said rounded peripheries of said second pair of drive rollers; and, c. means for mechanically biasing said second pair of drive rollers against said first pair of drive rollers to the extent to produce contacting forces at said rounded peripheries of about three ounces.

11. The mechanism as set forth in claim 10 wherein said biasing forces are produced solely by the force of gravity, acting upon said second pair of drive rollers and the support therefor.

* * * * *